US009758362B2

(12) United States Patent
Rider et al.

(10) Patent No.: US 9,758,362 B2
(45) Date of Patent: Sep. 12, 2017

(54) METHOD FOR EXTRACTING BEVERAGE FROM A BOTTLE

(71) Applicant: Coravin, Inc., Burlington, MA (US)

(72) Inventors: Mike Rider, Lowell, MS (US); Richard J. White, Middleton, MA (US)

(73) Assignee: Coravin, Inc., Burlington, MA (US)

( * ) Notice: Subject to any disclaimer, the term of this patent is extended or adjusted under 35 U.S.C. 154(b) by 101 days.

(21) Appl. No.: 14/789,223

(22) Filed: Jul. 1, 2015

(65) Prior Publication Data

US 2017/0001850 A1 Jan. 5, 2017

(51) Int. Cl.

| | |
|---|---|
| ***B67D 1/04*** | (2006.01) |
| ***B65D 23/08*** | (2006.01) |
| *B67D 1/00* | (2006.01) |

(52) U.S. Cl.

CPC ..... *B67D 1/0412* (2013.01); *B65D 23/0842* (2013.01); *B65D 23/0871* (2013.01); *B67D 1/0004* (2013.01); *B67D 2001/0481* (2013.01); *B67D 2001/0487* (2013.01)

(58) Field of Classification Search

CPC .. B67D 1/0412; B67D 1/0801; B67D 1/0004; B67D 2001/0812; B65D 23/0871; B65D 23/0842

USPC ..... 222/400.7, 399, 152

See application file for complete search history.

(56) References Cited

U.S. PATENT DOCUMENTS

| | | | | |
|---|---|---|---|---|
| 1,632,347 | A | 6/1927 | Pipkin | |
| 2,081,409 | A | 5/1937 | Rush | |
| 4,491,247 | A * | 1/1985 | Nitchman | B65D 77/06 220/586 |
| 4,867,209 | A | 9/1989 | Santoiemmo | |
| 5,020,395 | A | 6/1991 | Mackey | |
| 5,163,909 | A | 11/1992 | Stewart | |
| 8,225,959 | B2 | 7/2012 | Lambrecht | |
| 8,844,774 | B2 * | 9/2014 | Leys | B65D 83/0055 222/105 |
| 2011/0204093 | A1 * | 8/2011 | Lee | B67D 1/0004 222/152 |
| 2014/0097234 | A1 | 4/2014 | Shaw et al. | |
| 2014/0124530 | A1 * | 5/2014 | Craft | B67D 1/0418 222/23 |
| 2016/0318750 | A1 * | 11/2016 | McIntyre | C12H 1/14 |

* cited by examiner

*Primary Examiner* — Paul R Durand
*Assistant Examiner* — Robert Nichols, II
(74) *Attorney, Agent, or Firm* — Wolf, Greenfield & Sacks, P.C.

(57) ABSTRACT

Devices and methods for extraction of a beverage from a beverage bottle, such as a wine bottle, using an extraction device. The bottle may be supported by a bottle support sleeve that surrounds all but the neck and closure at the bottle opening. The extraction device may be secured to the neck and a needle, such a pair of needles or a two-lumen needle, may be inserted through the closure to inject pressurized gas into the bottle and to remove beverage from the bottle by the needle. The support sleeve may support the bottle during beverage extraction, e.g., by compressing the bottle exterior.

16 Claims, 14 Drawing Sheets

METHOD FOR EXTRACTING BEVERAGE FROM A BOTTLE

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

In one aspect of the invention, a method of extracting a beverage from a bottle having a neck with an opening closed by a closure includes providing the bottle in a bottle support sleeve such that only the neck and the closure are exposed outside of the sleeve and all remaining portions of the bottle are located in and covered by the bottle support sleeve. The bottle support sleeve may be constructed and arranged to support portions of the bottle below the neck during extraction of beverage from the bottle, e.g., the support sleeve may compress or otherwise hold portions of the bottle below the neck. In addition, the support sleeve may be arranged to vent any pressure introduced into the bottle that escapes through the bottle, e.g., in case the bottle breaks during extraction and pressurized gas in the bottle escapes from the bottle and into the sleeve. Thus, the support sleeve may allow pressure to be released in the case of bottle breakage during extraction, but portions of the bottle in the sleeve will be contained and shielded from a user. A beverage extractor may be secured to the neck of the bottle, such as by clamping a portion of the extractor to the bottle neck, and a needle of the beverage extractor may be inserted through the closure (such as a cork of a wine bottle) so that a distal end of the needle is positioned inside of the bottle. Thereafter, pressurized gas may be injected into the bottle via the needle while the bottle is positioned in the bottle support sleeve. The injected gas may be pressure regulated, e.g., to a pressure of 20-50 psi, or not regulated, and the support sleeve may aid to counteract pressure of the gas or otherwise support the bottle while the bottle interior is under pressure. For example, the support sleeve may compress the bottle from the exterior to at least partially counteract pressure at the bottle interior. However, in other embodiments, the sleeve may support the bottle without compressing the bottle. Beverage may be extracted from the bottle via the extractor needle while the bottle is positioned in the bottle support sleeve. For example, pressure in the bottle may allow beverage to flow through the needle and out of the bottle. In some embodiments, the extractor needle may include two lumens or two needles, one for gas and another for beverage, e.g., so that gas may be injected simultaneously with beverage flow out of the bottle.

In one embodiment, the bottle support sleeve may include an inflatable bladder located inside of a shell, wherein the inflatable bladder is inflatable to compress a bottle in the bottle support sleeve. In some embodiments, the support sleeve may include a tightening means arranged to reduce a size of the sleeve relative to a bottle in the sleeve. The tightening means, which may include an elastic element, strap, etc., may cause a portion of the sleeve to compress the bottle. The shell of the support sleeve may be made of a fabric, a polymer sheet, a molded or otherwise formed plastic or composite, etc., and may be arranged to withstand a force of the bottle on the shell interior, e.g., caused by pressure at the bottle interior. Thus, the shell may be flexible, rigid or have flexible and rigid portions. The bladder need not completely surround the bottle, but instead may be arranged to contact only certain desired sections of the bottle, such as near the bottle neck to help ensure the bottle is retained in the sleeve.

In some embodiments, the bottle support sleeve may be secured to the beverage extractor to resist removal of the bottle support sleeve from the bottle. For example, the bottle support sleeve and the beverage extractor may each include complementary locking members, such as snaps, clips, buckles, etc., arranged to engage with each other to secure the bottle support sleeve to the beverage extractor. In some cases, operation of the beverage extractor may be controlled based on whether a bottle support sleeve is in sufficient proximity to the extractor, indicating that a bottle being extracted from is located in the sleeve. For example, the beverage extractor may be enabled to inject pressurized gas into the bottle only in response to the beverage extractor recognizing an indicator of the bottle support sleeve. Such an indicator may be a machine readable identifier of the bottle support sleeve, e.g., an RFID tag or barcode, or a physical key or other element that can be recognized by the extractor, thereby enabling an operation of the extractor. Although in the example above, gas injection of the extractor is controlled based on recognizing a sleeve identifier, other extractor functions, such as movement of a needle to insert the needle into a bottle closure, may be controlled based on recognition of the identifier.

In one embodiment, the sleeve may include one or more windows, e.g., to allow a label on the bottle or other portion of the bottle to be observed through the window of the bottle support sleeve. Observation of a bottle portion may allow a user to determine a type of beverage being extracted, an amount of beverage remaining in the bottle, or simply provide an aesthetic appearance.

In some embodiments, the bottle support sleeve may include a handle grippable by a user to hold the bottle support sleeve, the bottle and a beverage extractor secured to the bottle. Thus, the support sleeve may allow a user to easily hold, and pour beverage from the combined bottle, sleeve, and extractor.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
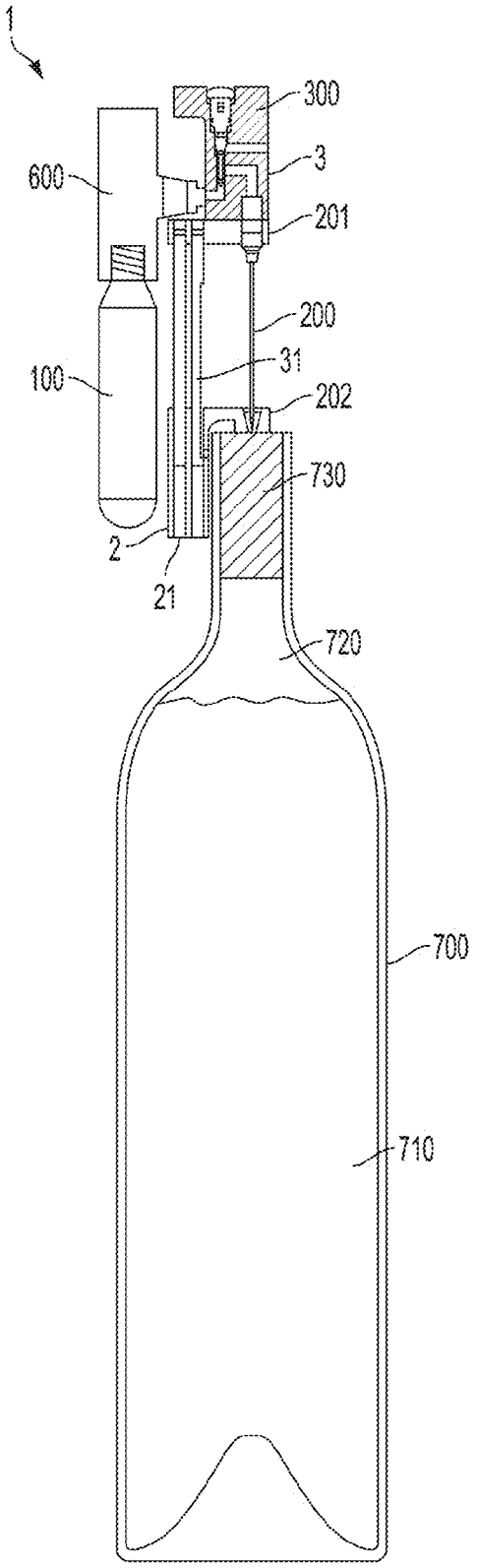
FIG. 1 shows a sectional side view of a beverage extraction device in preparation for introducing a needle through a closure of a beverage bottle.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device (or extractor) 1 that may be used in one or more aspects of the invention. This illustrative device 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. No. 4,867,209; U.S. Pat. No. 5,020,395; and U.S. Pat. No. 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the bottle 700 (such as a wine bottle), e.g., so that a pressure established inside the bottle 700 does not exceed a desired level. In other embodiments, no pressure regulation of the gas released from the cylinder 100 need be done, and instead, unregulated gas pressure may be delivered to the bottle 700.

In this embodiment, the body 3 also includes a valve 300 operable to control the flow of gas from the regulator 600. The valve 300 may be a 3-way toggle valve that includes a single operation button and functions to selectively introduce pressurized gas into the bottle 700 and extract beverage 710 (such as wine) from the bottle 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the bottle 700, and another for controlling flow of beverage from the bottle 700. Each valve could have its own actuator, allowing a user to selectively open and close the valves, whether individually or simultaneously. In short, details regarding the operation of the regulator 600 and valve 300 or other mechanisms for introducing gas into a bottle, and removing beverage from the bottle 700 are not necessarily limitations on aspects of the invention and may be modified as suitable.

To introduce gas into the bottle 700 and extract beverage, a needle 200 attached to the body 3 is inserted through a cork or other closure 730 that seals an opening at a neck of the bottle 700. This illustrative device 1 uses a pencil-tip non-coring needle 200 with a needle opening 220 along a sidewall of the needle near the needle tip. While the needle 200 may be inserted into the cork or other closure 730 in different ways, in this embodiment, the device 1 includes a base 2 with a pair of channels 21 that receive and guide movement of respective rails 31 of the body 3. Thus, movement of the body 3 and attached needle 200 relative to the bottle closure 730 may be guided by the base 2, e.g., the body 3 may slide relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In some embodiments, the base 2 may be fixed or otherwise held in place relative to the bottle 700, e.g., by a clamp arm, sleeve, strap or other device that engages with the bottle 700. Clamp arrangements in accordance with aspects of the invention are described in more detail below and may be used to temporarily or releasably secure the device 1 to a wine bottle neck. By restraining movement of the base 2 relative to the bottle 700, such an arrangement may help guide motion of a needle 200 relative to the bottle 700 when penetrating a closure 730, or when being withdrawn from the closure 730. Alternately, the bottle 700 may be manipulated by grasping and manipulating the device 1 since the clamp engaging the device 1 to the bottle 700 may securely hold the device 1 and bottle 700 together.

Figure 2:
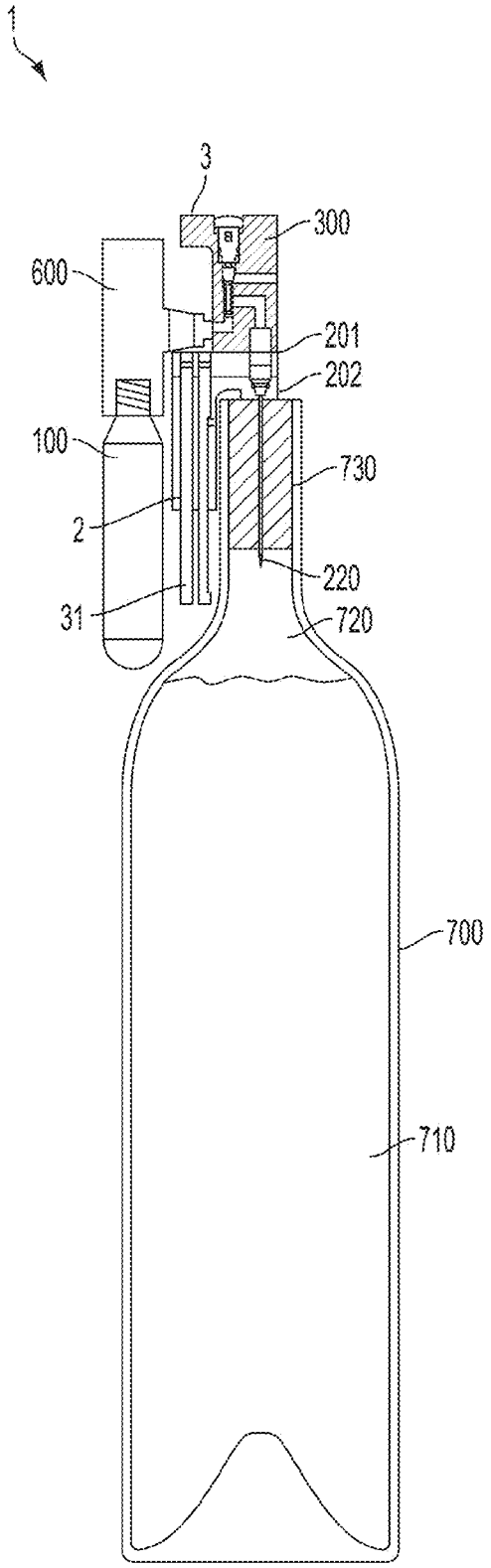
FIG. 2 shows the FIG. 1 embodiment with the needle passed through the closure.
Figure 3:
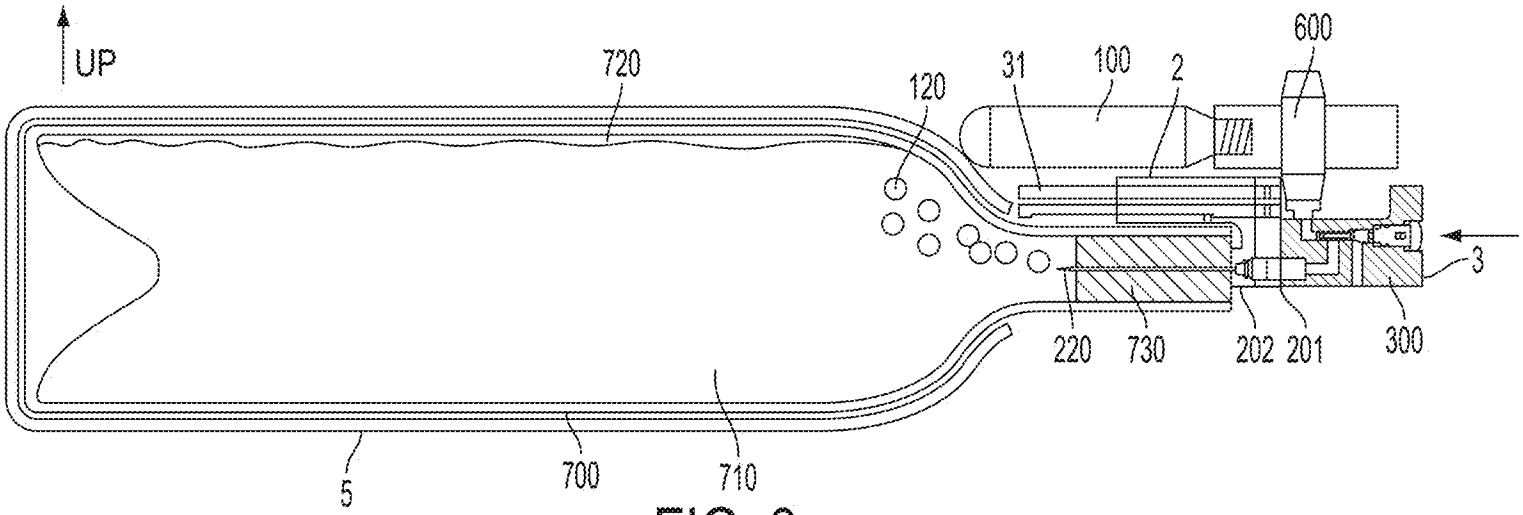
FIG. 3 shows the FIG. 1 embodiment while introducing gas into the bottle.
Figure 4:
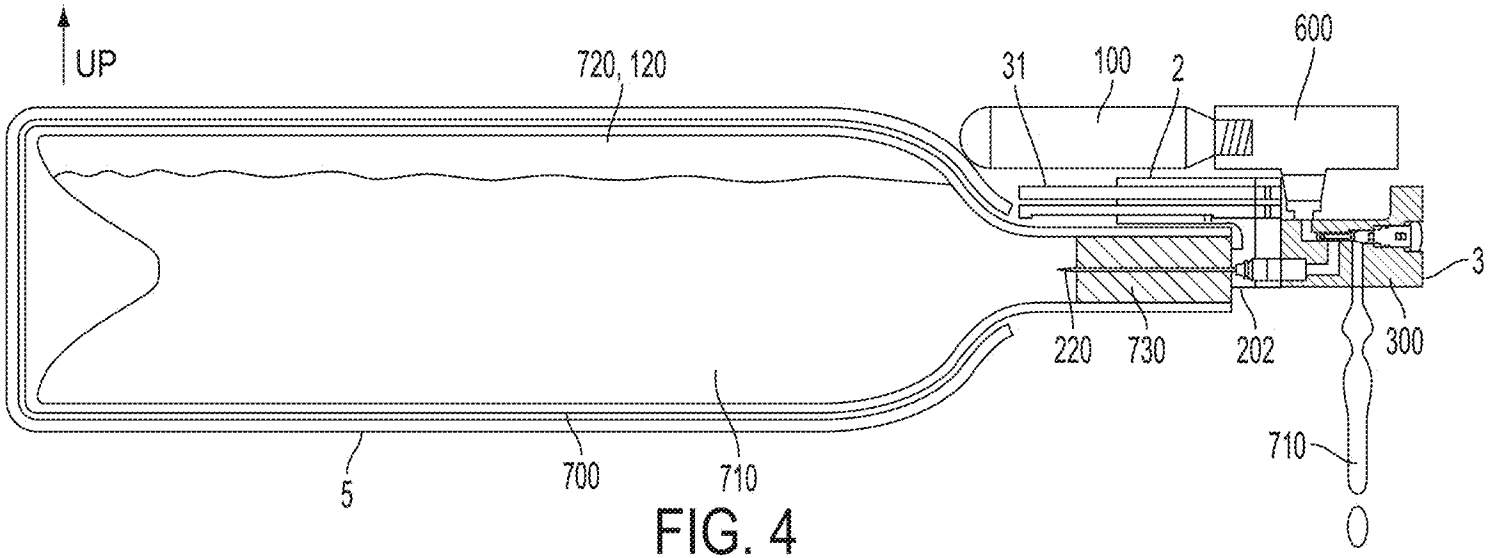
FIG. 4 shows the FIG. 1 embodiment while dispensing beverage from the bottle.

To insert the needle 200 through the closure 730, a user may push downwardly on the body 3 while maintaining the base 2 and the bottle 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the bottle 700. The bottle 700 may then be tilted, e.g., so that the beverage 710 flows to near the closure 730 and any air or other gas 720 in the bottle 700 flows away from the closure. Pressurized gas 120 may then be introduced into the bottle 700 by actuating the valve 300 and causing gas from the cylinder 100 to flow through the valve 300 and needle 200 to exit at the needle opening 220, as shown in FIG. 3. Alternately, pressurized gas 120 can be introduced into the bottle 700 prior to tilting of the bottle, followed by tilting and dispensing of beverage. Thereafter, the valve 300 may be operated to stop the flow of pressurized gas and allow beverage 710 to flow into the needle opening 220 and through the needle 200 to be dispensed from the valve 300, as shown in FIG. 4.

As discussed above, in one aspect of the invention, a bottle may be supported by a support sleeve during beverage extraction. Support of the bottle may take different forms, such as compressing the bottle exterior to help counteract or balance any internal pressure introduced by the injection of pressurized gas into the bottle, or allowing a user to grasp a handle on the sleeve to hold the bottle during extraction, or providing a slip-resistant gripping surface for the user, or resisting force of the bottle or bottle portions at an interior of the support sleeve. For example, during beverage extraction using the device described in FIGS. 1-4, pressurized gas is introduced into the bottle to help move beverage out of the bottle via the needle inserted into the cork. As can be seen in FIGS. 3 and 4, a support sleeve 5 may be positioned around the entire bottle 700 other than the neck and closure 730, which are exposed so that the extraction device 1 can engage the bottle 700 and penetrate the closure 730. The sleeve 5 may fit closely to the bottle 700 exterior, e.g., so that the bottle 700 is compressed by the sleeve 5. In some embodiments, the support sleeve 5 may include an elastic element, such as a neoprene fabric, rubber or other elastomer sheet, or other resilient element that serves to engage the sleeve 5 with the bottle 700 with an elastic force. In other embodiments, the sleeve 5 need not include an elastic element, but still may engage the bottle 700 so the bottle 700 is compressed. For example, the sleeve 5 may include a tape or belt that is wound around the bottle 700 so as to compress the bottle 700 exterior.

Figure 5:
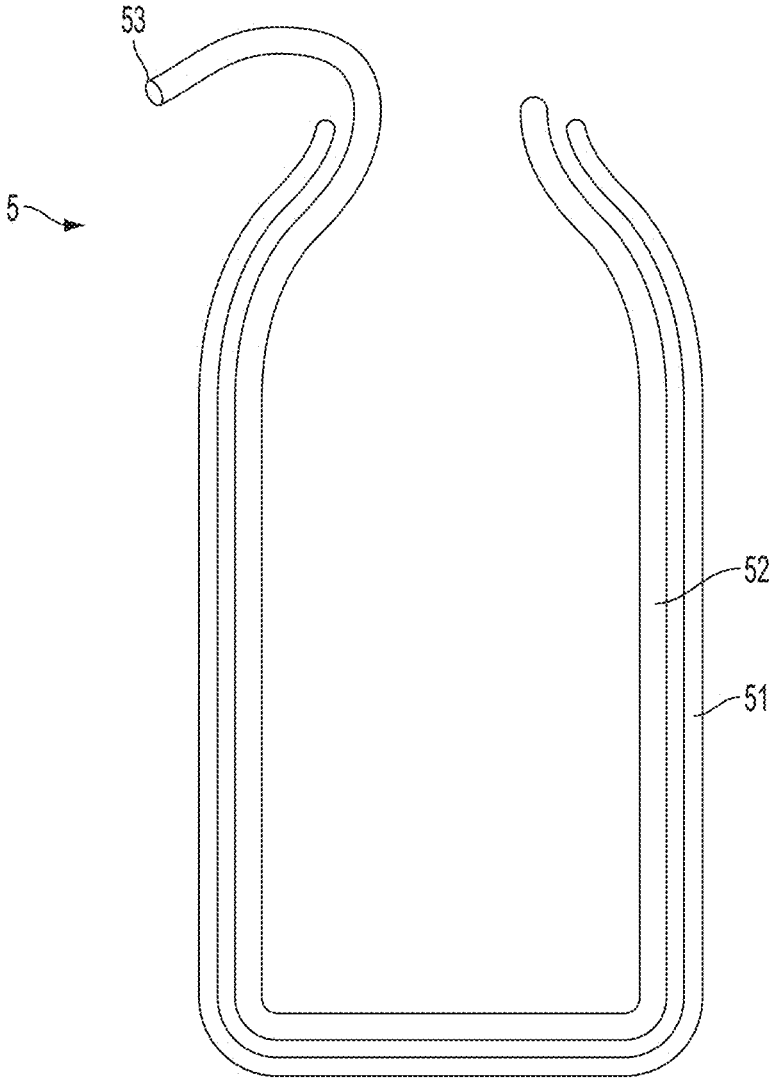
FIG. 5 shows a sectional side view of a beverage support sleeve in an illustrative embodiment.

In another arrangement shown in FIG. 5, the sleeve 5 may include a bladder 52 that can be inflated so as to contact and compress the bottle 700. The bladder 52 may be positioned inside of an outer shell 51, which may be made of a woven or non-woven fabric in the approximate shape of a bottle 700, a rigid plastic, composite, metal or other material (e.g., a molded plastic), or other body in which the bladder 52 is contained. The shell 51 may be made resistant to cutting or puncturing such as what might be caused by a piece of broken glass from a bottle 700. For example, the shell 51 may be made to resist penetration by a piece of broken glass such that the glass is prevented from piercing through the sleeve 5. In some cases, the shell 51 may be formed integrally with the bladder 52, e.g., the shell 51 may be adhered to the bladder 52 or a part of the bladder 52 itself may form the shell 51. The bladder 52 may include an inlet 53 where fluid may be introduced into the bladder 52. For example, the inlet 53 may include a valve (such as a Schrader valve), a connector (such as Luer connector), and/or other components that allow the bladder 52 to receive and hold a fluid (whether gaseous and/or liquid). In one embodiment, the inlet 53 may be connected to receive pressurized gas from the cylinder 100, e.g., via a threaded connection on the body 3 to which the inlet 53 is attached. Gas may be delivered to the bladder 52 by operating a valve on the body 3 and/or at the inlet 53. By inflating the bladder 52, the bladder may compress a bottle 700 in the support sleeve 5, e.g., to attach the sleeve 5 to the bottle 700. If made of fabric, the shell 51 may be made of a neoprene, a woven nylon or other suitable material, a blown, extruded or otherwise formed sheet, etc., and the shell 51 may be made of multiple pieces (e.g., which are sewn or otherwise attached together) or as a single piece. In some cases, the shell 51 may be made of a mesh, but where the shell 51 (and/or bladder 52) include openings, the openings are relatively small in size to ensure that the sleeve 5 covers the bottle 700. That is, any openings in the sleeve 5 should have a maximum size of about 0.25 inches or less. The shell 51 may be made to resist expansion of the bladder 52 to help ensure proper compression of the bottle 700, if the bladder 52 is used. For example, the shell 51 may be made highly resistant to expansion, or may be made to expand (e.g., include an elastic component), so that as the bladder 52 is inflated, the shell 51 resists expansion of the bladder 52 so the bottle 700 is compressed.

Another feature of the sleeve 5 is that the sleeve 5 is arranged to support portions of the bottle inside of the sleeve 5, and can vent any pressure introduced into the bottle that escapes through the bottle, e.g., if the bottle is broken during extraction. Thus, if the bottle breaks with pressure contained in the bottle, one or more pieces of the bottle may be contained in the sleeve 5 and shielded from a user and any pressure in the bottle may be vented through the sleeve 5, e.g., via one or more vent openings, valves, or other structures arranged to allow pressure inside of the sleeve to escape.

Figure 6:
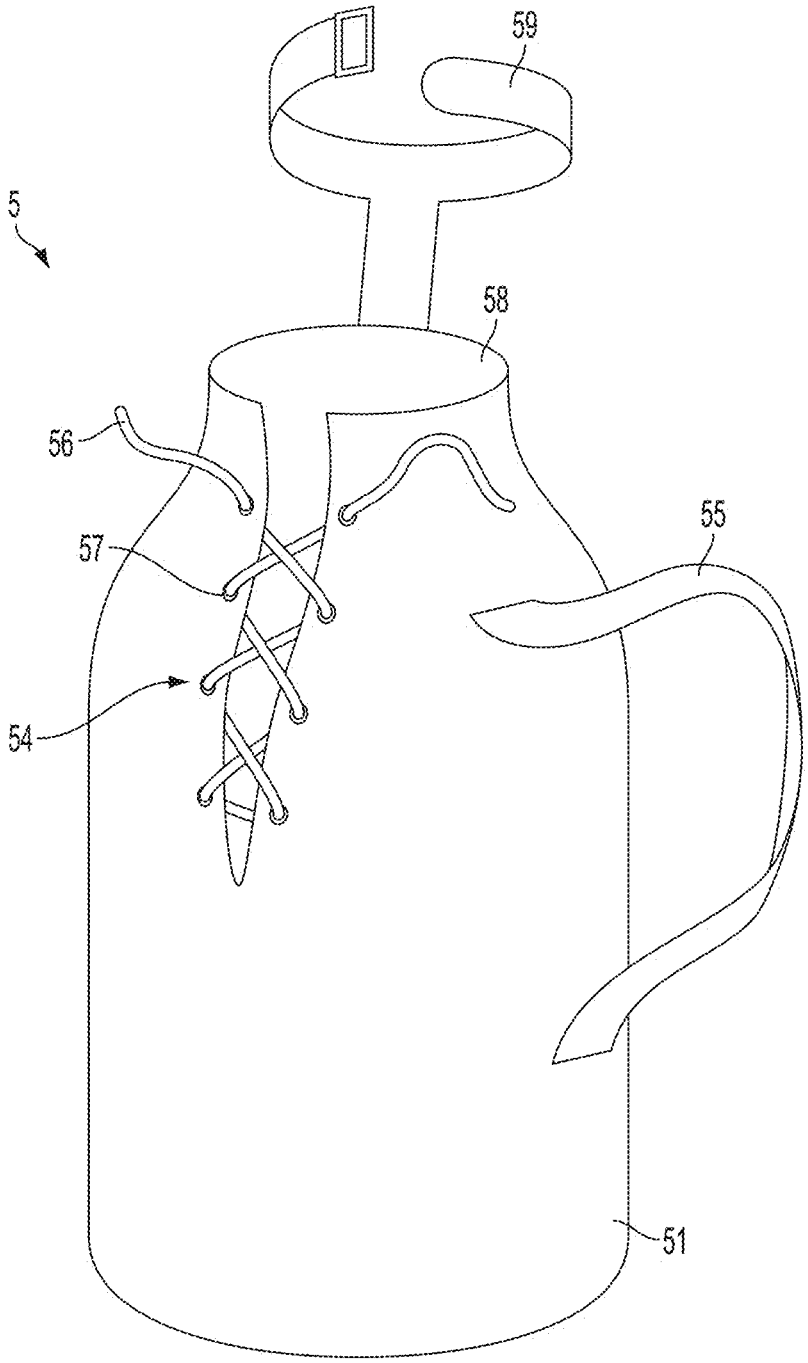
FIG. 6 shows a front perspective view of an embodiment of a support sleeve having a handle, tightening means and an indicator.

As noted above, the sleeve 5 may have a tightening means 54 to help secure the sleeve 5 to a bottle 700, e.g., in the form of an elastic member or bladder. However, the tightening means may take other forms. For example, FIG. 6 shows a tightening means 54 that includes a plurality of eyelets 57 formed in a shell 51 and a lace 56 engaged with the eyelets 57 so that the shell 51 can be tightened or closed around a bottle 700. Activation of the tightening means 54 may compress the bottle 700 or otherwise reduce a size of the shell 51 in at least one portion, such as at an opening 58 where a bottle neck is located. Other tightening means 54 may include a zipper, hook and loop fasteners, clips, buckles, button and eye fasteners, an elastic panel or other resilient element (such as a shock cord or elastic line), and others.

As also shown in FIG. 6, the sleeve 5 may include a handle 55 to help support a bottle 700. For example, a handle 55 secured to the shell 51 may help a user support the bottle during transport or beverage extraction. In this embodiment, the handle 55 includes a piece of flat webbing that is attached to the shell 51 at opposite ends. Other handle 55 arrangements are possible, such as a rigid U-shaped handle, finger grip features on the shell 51, a knob or post extending from the shell 51, and others.

In some embodiments, the handle 55 or other sleeve portion may engage with the extraction device 1, e.g., to help support the extraction device 1 and bottle 700 during beverage extraction. For example, the sleeve 5 may have a portion that engages with the base 2 of the device 1 so that the sleeve 5 and the device 1 are connected together. In one embodiment, the sleeve 5 may include a strap, buckle, snap closure, clamp, or other structure 59 that engages with the base 2. In the embodiment of FIG. 6, the engagement structure 59 includes a strap and buckle arranged to extend around the base 2 and the neck of the bottle 700 so as to secure the base 2 to the bottle 700 and the sleeve 5 to the base 2. Thus, in some cases, the engagement structure 59 that connects the sleeve 5 and the base 2 may additionally attach the base 2 to the neck of the bottle 700. In another embodiment, the extraction device 1 and the sleeve 5 may include complementary locking members that engage with each other. For example, the device 1 and sleeve 5 may include male and female buckles that are engageable with each other to secure the sleeve 5 to the device 1. Other locking members include complementary snaps, hooks, etc.

In some cases, the engagement structure 59 or other sleeve portion may include an indicator device that enables the extraction device 1 to operate. For example, the engagement structure 59 may include an RFID tag, barcode or other machine readable identifier, a physical key, or other structure that interacts with the extraction device 1 and enables the device 1 to operate. In an embodiment where the engagement structure 59 includes an RFID tag, the device 1 may include an RFID reader that reads the tag, and a control circuit that permits the device 1 to operate, e.g., by allowing the regulator valve to release gas, only if a suitable authorization code or other indicia is received from the tag. In an embodiment where the engagement structure 59 includes a physical key, the key may be inserted into or otherwise engaged with the device 1, thereby allowing the device 1 to operate, e.g., the key may open a valve that allows gas release from the regulator and/or the key may allow the body 3 to move relative to the base 2 where the body 3 is otherwise locked in place relative to the base 2. This type of arrangement may ensure that the sleeve 5 is in place prior to operation of the beverage extraction device 1.

Figure 7:
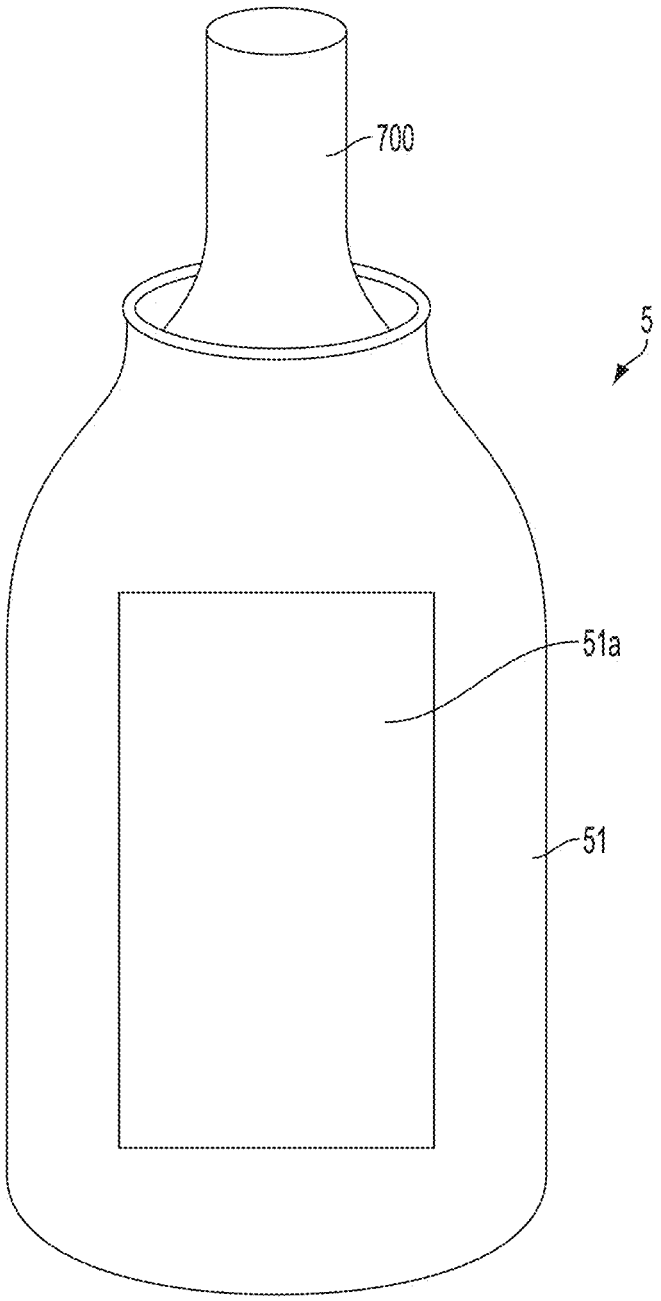
FIG. 7 shows a support sleeve having a window in one embodiment.

In another aspect, a support sleeve may include a window that allows viewing of a portion of the bottle 700, such as a label or to allow confirmation of an amount of beverage remaining in the bottle 700. However, the window is not arranged to be completely open, but rather serves to cover a portion of the bottle 700 while allowing viewing of the bottle portion. In some cases, a window may be formed of a transparent vinyl or other material that allows viewing of the bottle portion while still covering the bottle portion. FIG. 7 shows an illustrative embodiment of a sleeve 5 with a shell 51 having a window 51*a* formed as a piece of transparent vinyl. The window 51*a* is secured in an opening of the shell 51, which may be made of a sheet of neoprene or other fabric, whether woven, non-woven, extruded, mesh, etc. Although in this embodiment the window 51*a* has a rectangular shape, the window 51*a* may have any suitable size and/or shape. For example, the window 51*a* may have a size to allow viewing of a label on the bottle 700, to allow a user to determine how much beverage is left in a bottle, or may have a size and/or shape that is purely decorative.

Figure 8:
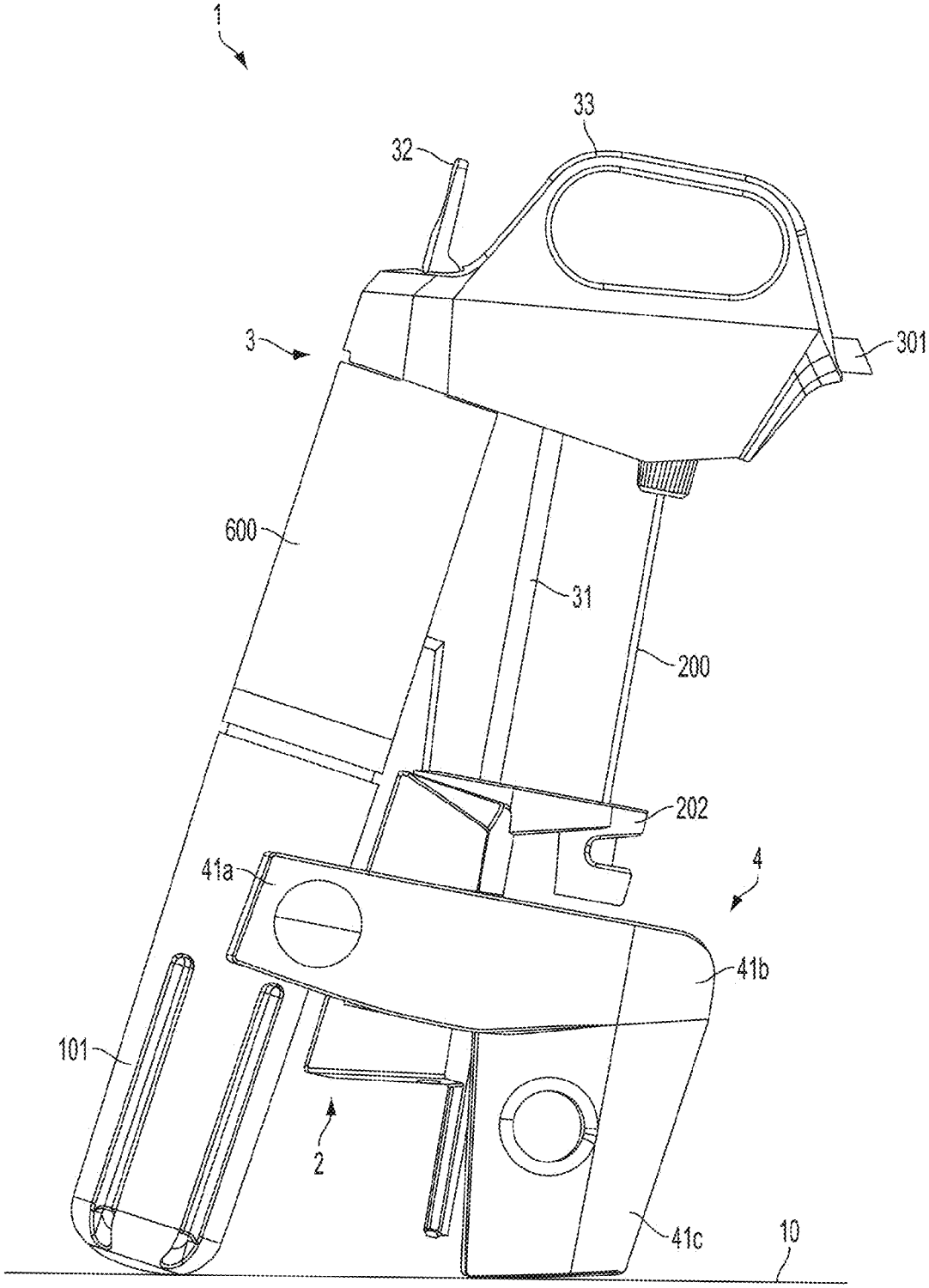
FIG. 8 shows a perspective side view of a beverage extraction device in an illustrative embodiment.
Figure 9:
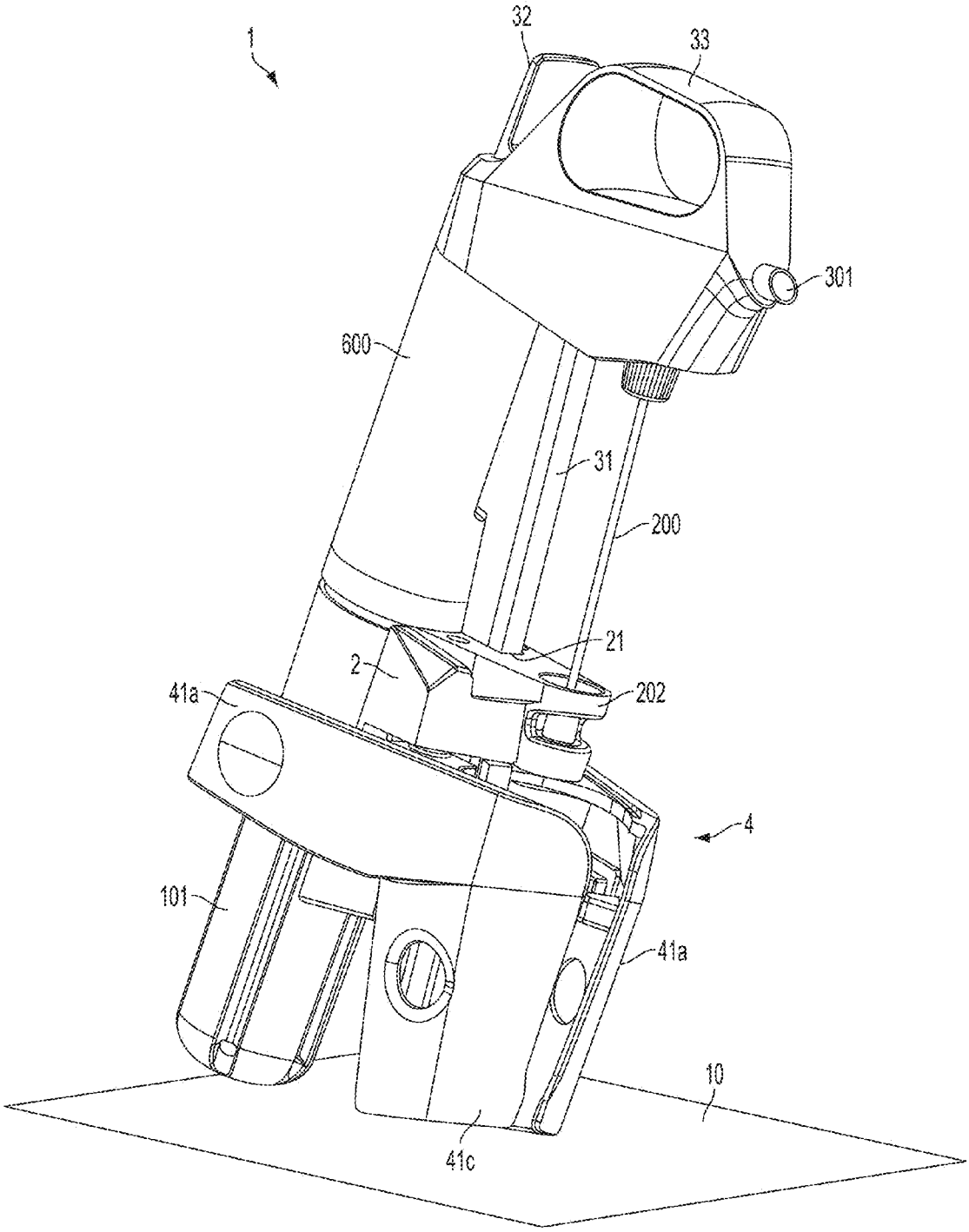
FIG. 9 shows a perspective view of the extraction device of FIG. 8.

FIGS. 8 and 9 show a illustrative embodiment of a beverage extraction device 1 that can be used with aspects of the invention. This embodiment is similar in operation to that of FIGS. 1-4, but has a few different features. In this embodiment, the body 3 includes a handle 33, that may be gripped by a user for moving the body 3 relative to the base 2 in upward and downward motions to insert a needle 200 through a cork or other closure of a bottle 700. Also, a lever 32 is provided for operating the valve 300, e.g., to dispense beverage from an outlet 301 and/or deliver gas to the bottle 700 via the needle 200. To allow movement of the body 3 relative to the base 2, the body 3 includes a rail 31 that has T-shaped cross section, and is arranged to move within a T-shaped receiving slot or channel 21 of the base 2. As discussed above, however, other arrangements are possible for engaging the body 3 and base 2 while allowing for movement of the needle 200. Also, a gas cylinder cover 101 threadedly engages with the body 3 at the regulator 600 to engage and hold the cylinder 100 in place relative to the body 3. (A gas cylinder cover 101 in this embodiment is a kind of cap that covers the gas cylinder 100 and threadedly engages with another part of the body 3 to hold the gas cylinder 100 in place.) This arrangement of a gas cylinder cover 101 allows for the use of gas cylinders 100 that do not threadedly engage with the regulator 600, but rather are held in engagement with the regulator 600 by the cover 101.

As discussed above, a beverage extraction device may include a clamp configured to engage the device with a bottle, e.g., by clamping the device to the neck of a bottle. For example, the device can include one or more clamp arms that are movably mounted to the device and are arranged to engage with a bottle to support the device on the bottle during use. The embodiment of FIGS. 8 and 9 has a clamp 4 having a pair of clamp arms 41 that are optionally arranged to support the device 1 in an upright orientation on a flat, horizontal surface 10, such as a table or counter top. (It should be appreciated, however, that a single clamp arm may be provided instead of a pair, as described in more detail below.) In this embodiment, the clamp arms 41 each include a downwardly extending portion 41*c* that contacts the surface 10 along with a lowermost portion of the body 3, which in this example is a lower end of gas cylinder cover 101.

The clamp arm(s) may also include a feature to help properly engage the clamp arm(s) with a variety of different bottle necks. For example, different bottles may have different neck diameters, different lip diameters or lengths (as used herein, a lip is a feature of many wine bottles near the top of the neck in which the bottle flares, steps or otherwise protrudes outwardly in size). In one embodiment, the clamp arm(s) include a distal tab feature and a proximal ridge feature that cooperate to properly engage with different neck configurations. FIGS. 8-12 show one illustrative embodiment in which each clamp arm 41 includes a distal tab 43 and a proximal ridge 44. The tab 43 may extend radially inwardly somewhat more than the ridge 44, and thus help to center the bottle neck or otherwise appropriately position the neck relative to the clamp arms 41. For example, as the clamp arms 41 are closed on a neck, the tabs 43 may contact the neck before the ridges 44, helping to center or otherwise appropriately position the neck relative to the device 1. In some embodiments, the tabs 43 and/or the ridges 44 may have portions that contact the bottle neck have a relatively hard, low-friction surface to help allow the clamp arms 41 engage the neck while allowing the neck to shift in position relative to the clamp arms 41. The tabs 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, the needle guide 202 and needle 200 may be arranged to pierce a closure 730 in a location that is offset from a center of the closure 730 with the neck positioned in contact with the pad 22. This may help avoid having the needle 200 penetrate the closure in the same location if the device 1 is used two or more times to extract beverage from the bottle 700. (As noted above, beverage can be extracted without removal of the closure 730, and since the closure can reseal after removal of the needle, beverage can be extracted multiple times from a bottle 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

Figure 10:
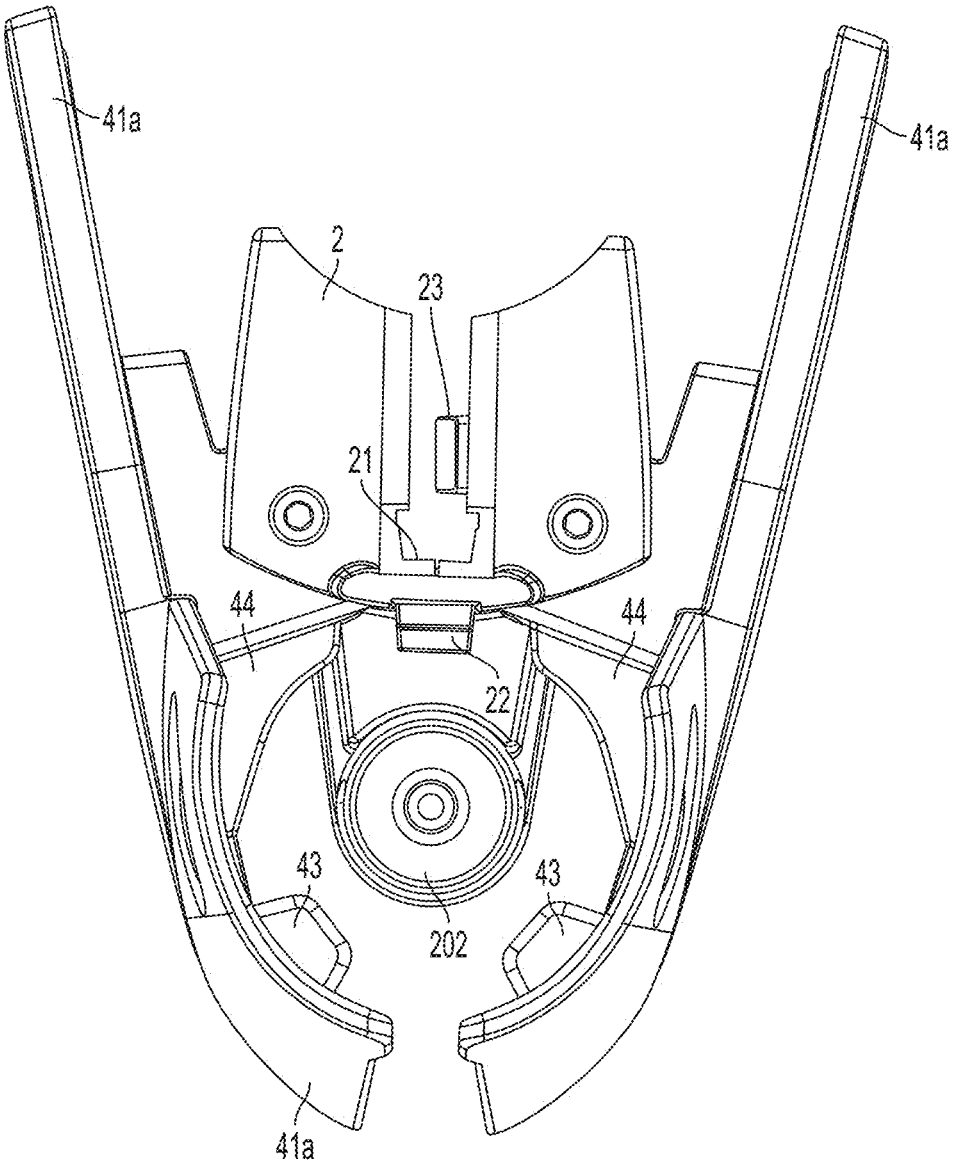
FIG. 10 shows a bottom view of the extraction device of FIG. 8.
Figure 11:
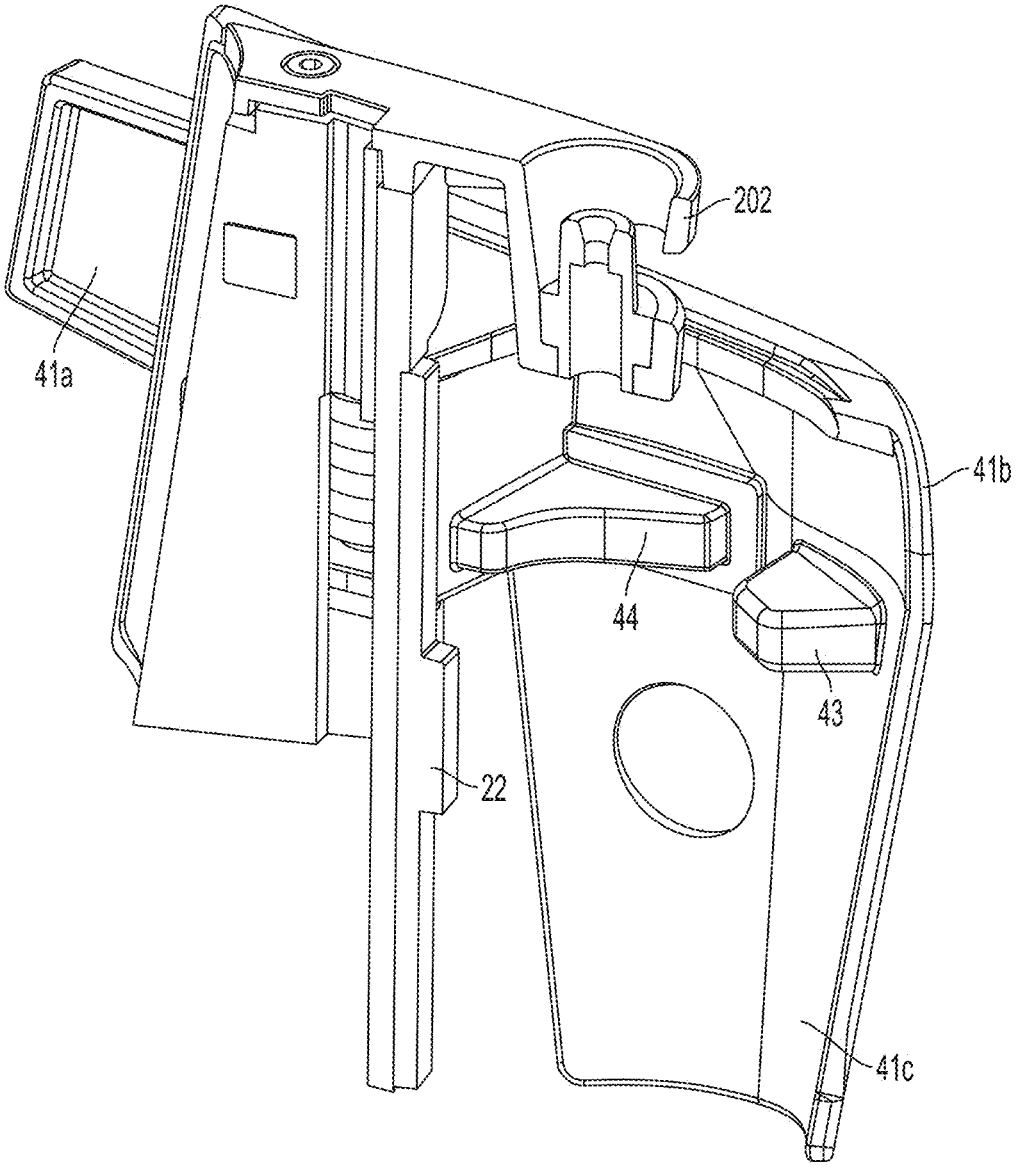
FIG. 11 shows a side view of an inner surface of a clamp arm of the FIG. 8 embodiment.

The ridge 44, though optional, may have a length measured in a direction perpendicular to a bottle neck (or in a direction perpendicular to the length of the needle 200) that is greater than the tab 43, e.g., to help the ridge 43 provide a suitably long contact surface for the lip of the bottle. For example, while the tabs 43 may help center the neck between the clamp arms 41 and urge the neck to move proximally, the ridges 43 may contact an underside of the bottle lip with a suitably long surface to help prevent the neck from moving downwardly relative to the clamp arms 41 more than a desired distance. The extended length of the ridges 44 may provide the ridges 44 with greater strength and help the clamp arms operate with a wide array of bottle neck and lip sizes and shapes. In addition, the ridges 44 may have a variable radial length, e.g., increasing proximally as shown in FIG. 10, to help ensure that the ridges 44 will provide suitable engagement with a variety of different necks having different lip dimensions.

The pad 22 in this illustrative embodiment includes a strip of resilient material, such as a rubber, that can help the device grip the bottle neck when engaged by the clamp arms 41. In some embodiments, the pad 22 may include a protrusion or step near a lower portion of the pad 22 (see FIGS. 11 and 12) so that the pad 22 can engage with a lower surface of a lip on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the device is standing upright on the surface 10. Also, the needle 200 may be movable relative to the clamp arms 41 to be positioned within a space between the clamp arms 41 throughout its full range of movement.

In this embodiment, the device 1 includes a detent that resiliently holds the body 3 in an upper position relative to the base 2, e.g., to help ensure that the body 3 does not move relative to the base 2 while at rest on a counter top. For example, the detent may include a spring-loaded ball or other element mounted on the base 2 that engages with a suitable groove on the body 3 to hold the body 3 and base 2 stationary relative to each other until suitable force is exerted to overcome the detent holding function. (See, for example, FIGS. 10 and 12 which show a detent 23 that includes a spring loaded plunger mounted to the base 2 that is arranged to engage with a groove or other feature on the rail 31 of the body 3.) Other detent arrangements are possible, such as a spring-loaded tab and slot, and others as will be appreciated by those of skill in the art. Moreover, a detent is not required to releasably hold the body 3 and base 2 in one or more positions relative to each other. For example, a friction element (such as a rubber strip positioned between the rail 31 and channel 21) may be included to provide a friction force that maintains the body and base stationary in the absence of a force over a threshold level. The friction element may provide the friction force for specific body/base positions, or throughout the full range of body/base movement. Other configurations are possible to help hold the body 3 and base 2 in one or more positions relative to each other, such as a spring-loaded pin, latch or other lock, a thumbscrew on the base 2 that can be tightened to engage the rail 31 and prevent body/base movement, etc.

Figure 12:
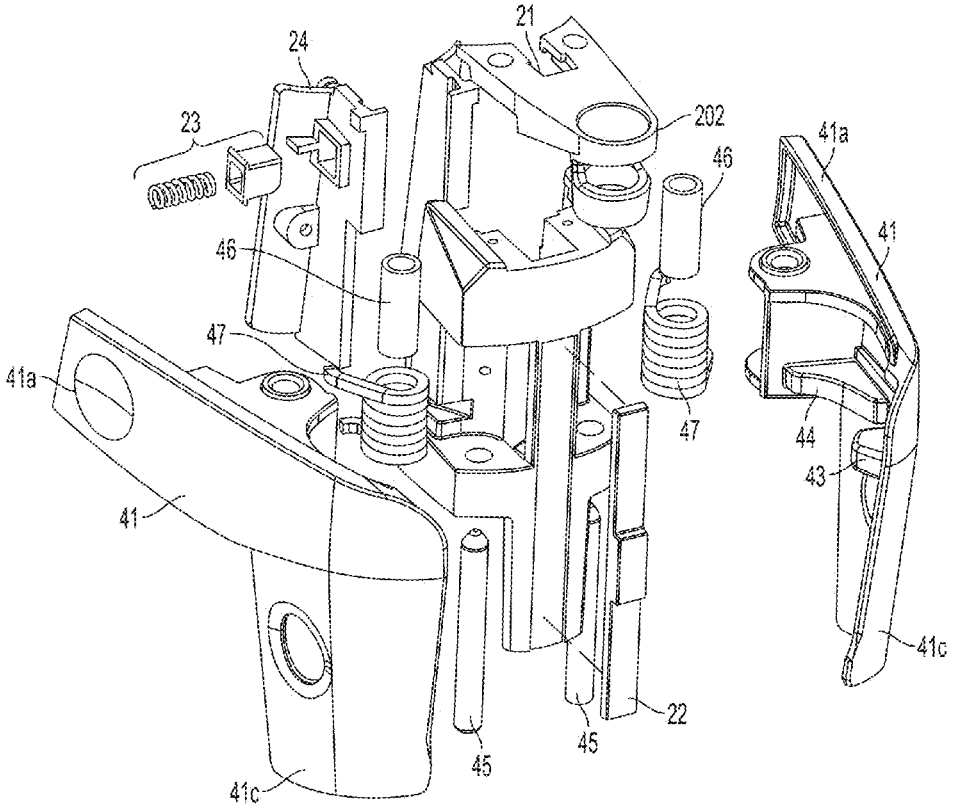
FIG. 12 shows an exploded view of the base in the FIG. 8 embodiment.

In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 12, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in this embodiment the arms are still said to be moveable relative to each other). Torsion or other springs may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the bottle 700, or even to allow a user to lift and pour beverage from the bottle 700 by grasping and manipulating the device 1. The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the bottle.

That is, whether the clamp arms 41 are spring biased or not, movement of the arms may be restricted or otherwise controlled in some way by a locking mechanism. For example, the arms 41 may be secured together by a ratchet and pawl mechanism that allows the distal portions 41*b* of the clamp arms 41 to move freely toward each other, but prevents movement of the distal portions 41*b* away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the bottle 700.

Figure 13:
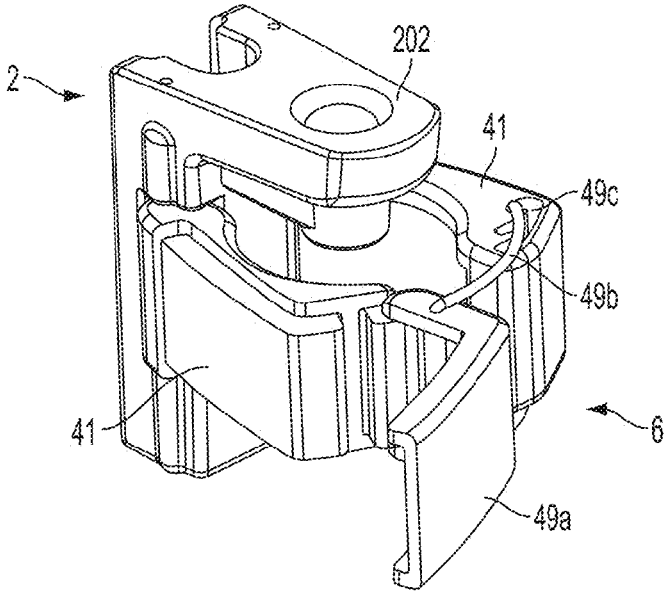
FIG. 13 shows a perspective view of a locking mechanism for a clamp in an illustrative embodiment in an open condition.
Figure 14:
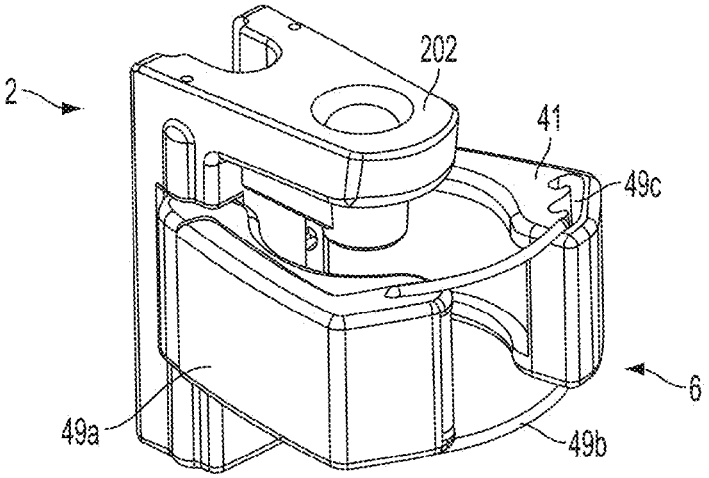
FIG. 14 shows the FIG. 13 embodiment with the clamp in a closed condition.

For example, FIGS. 13 and 14 show an illustrative embodiment in which the clamp arms 41 include a locking mechanism 6 in the form of a buckle similar to that found in some ski boots. In this embodiment, the locking mechanism 6 includes a handle 49*a* that is pivotally mounted to a clamp arm 41 and carries a bail 49*b*. The bail 49*b* is arranged to selectively engage with one of the bail-engaging slots 49*c* formed in the other clamp arm 41. Accordingly, the locking mechanism 6 in this embodiment is arranged to provide three different positions of the bail 49*b* on the bail-engaging slots 49*c*, thus allowing the locking mechanism to provide three different adjustment positions for engaging different sized bottle necks. To engage the clamp arms 41 to a neck, the bail 49*b* is engaged with a suitable slot 49*c*, and the handle 49*a* is rotated to lock the clamp arms 41 is place. Of course, other locking mechanisms are possible. Thus, the clamp 4 may include a locking mechanism that has a single locking position, multiple locking positions, a continuously variable locking position, a series of indexed or stepped locking positions, and/or a user defined locking position. Such clamp arm securing arrangements may be used whether the distal portions 41*b* of the clamp arms 41 are biased to move toward each other, away from each other, or with no bias at all.

Figure 15:
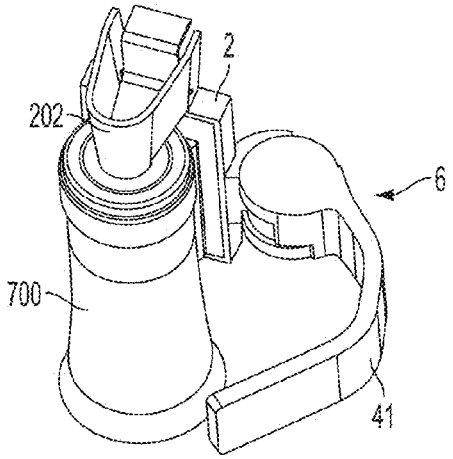
FIG. 15 shows an illustrative embodiment of a clamp arrangement having a single clamp arm.
Figure 16:
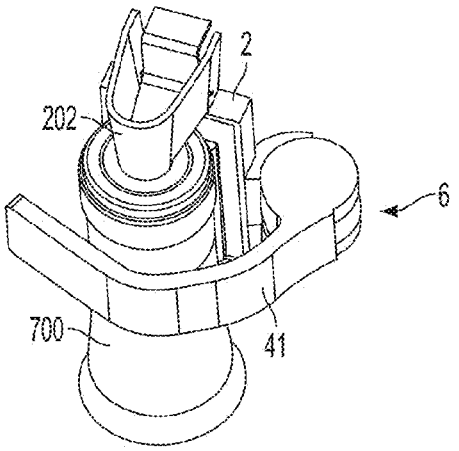
FIG. 16 shows the FIG. 15 embodiment with the clamp arm in the closed position.
Figure 17:
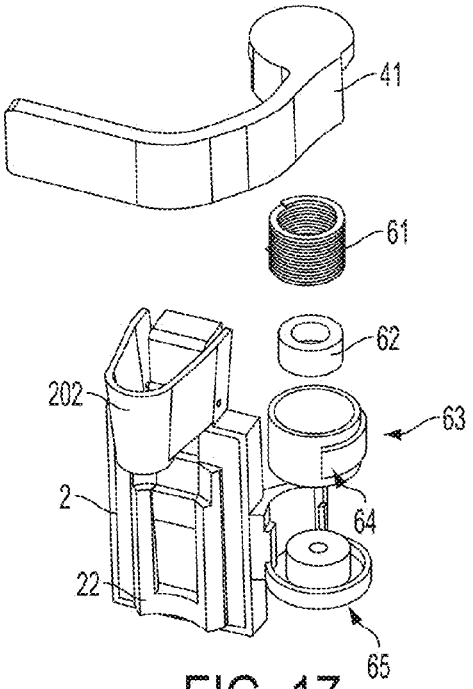
FIG. 17 shows an exploded view of a locking mechanism used with the FIG. 15 embodiment.

FIGS. 15-17 show another embodiment of a bottle clamp arrangement that includes a single clamp arm and that optionally can be configured to engage a bottle neck so that the closure is penetrated at an off-center position. (It should be appreciated, however, that the FIGS. 15-17 clamp arrangement could be used in a device that penetrates the closure at a center position as well.) In this embodiment, the clamp arrangement includes a single clamp arm 41 that is pivotally mounted to the base 2. A locking mechanism 6 is arranged to permit a user to freely move the clamp arm 41 from an open position (shown in FIG. 15) toward a closed position (shown in FIG. 16), but resists movement of the arm 41 from a closed position toward an open position. As a result, the device 1 can be associated with a bottle neck as in FIG. 15, and the clamp arm 41 moved to engage the neck as in FIG. 16 so that the device 1 is supported on the bottle. With the clamp arm 41 engaging the neck in a closed or clamping position, the arm 41 cannot be moved toward an open position unless the locking mechanism 6 is released. Thus, the device 1 may be engaged with the bottle and remain engaged with the bottle until a user releases the clamp arm 41. The clamp arm 41 and/or the pad 22 (see FIG. 17) may be arranged so that the neck is engaged to position a center of the closure 730 away from a penetration point of the needle 200, and thus ensure off-center penetration. For example, the pad 22 may have a semi-circular surface that contacts a bottle neck so as to offset the center of the closure 730 from a penetration point of the needle 200.

While the locking mechanism 6 may be arranged in other ways, in this embodiment the locking mechanism 6 includes a clutch spring 61 that is fitted over, and is engageable with an upper binding post 62 that is fixed to the clamp arm 41 and a lower binding post 65 that is fixed to the base 2. As will be understood by those of skill in the art, the clutch spring 61 may engage the binding posts 62, 65 so as to allow movement of the clamp arm 41 in a clockwise direction (as viewed from above) relative to the lower binding post 65, yet resist counterclockwise movement. A sleeve 63 may house the clutch spring 61 and a release tab 64 may be movable by a user to release the clutch spring 61 from the upper binding post 62 so as to allow the clamp arm 41 to move in the counterclockwise direction. Another spring (not shown) may be used to bias the clamp arm 41 to move toward the open position, e.g., so that the arm 41 moves under the spring bias to the open position when the release tab 64 is activated. Other arrangements for the locking mechanism are possible, such as ratchet and pawl configurations, rotary detents, etc.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the bottle and any remaining beverage to be stored for months or years without abnormal alteration of the beverage flavor. Further, such needles may be used to penetrate a foil cover or other wrapping commonly found on wine bottles and other bottles. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening or through hole of the guide 202 could be arranged to introduce the needle at a location offset from the center of cork 730. This may decrease the chances that a needle penetrates the closure 730 in a same location if the system 1 is used to dispense beverage from the bottle several times and may allow the closure 730 to better reseal upon needle withdrawal.

While in the above embodiments, a user moves the body 3 in a linear fashion relative to the base 2 to insert/remove a needle with respect to a bottle closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the bottle while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a bottle to extract beverage from the bottle. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the bottle during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas bottles filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the bottle, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the bottle and extract beverage from the bottle. However, in other embodiments two or more needles may be used, e.g., one needle for gas delivery and one needle for beverage extraction. In such an embodiment, the valve 300 may operate to simultaneously open a flow of gas to the bottle and open a flow of beverage from the bottle. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A method of extracting a beverage from a bottle having a neck with an opening closed by a closure, comprising:

providing the bottle in a bottle support sleeve such that the bottle support sleeve compresses portions of the bottle, only the neck and the closure are exposed outside of the bottle support sleeve and all remaining portions of the bottle are located in and covered by the bottle support sleeve, the bottle support sleeve being constructed and arranged to support portions of the bottle below the neck during extraction of beverage from the bottle and to vent any pressure introduced into the bottle that escapes through the bottle and into the bottle support sleeve;

securing a beverage extractor to the neck of the bottle;

inserting at least one needle of the beverage extractor through the closure such that a distal end of the at least one needle is positioned inside of the bottle;

injecting pressurized gas into the bottle via the at least one needle while the bottle is positioned in the bottle support sleeve; and extracting beverage from the bottle via the at least one needle while the bottle is positioned in the bottle support sleeve.

2. The method of claim 1, wherein the bottle support sleeve includes an inflatable bladder located inside of a shell, wherein the inflatable bladder is inflatable to compress a bottle in the bottle support sleeve.

3. The method of claim 1, further comprising securing the bottle support sleeve to the beverage extractor secured to the bottle to resist removal of the bottle support sleeve from the bottle.

4. The method of claim 1, further comprising observing a label on the bottle through a window of the bottle support sleeve.

5. The method of claim 1, wherein the bottle support sleeve includes a handle grippable by a user to hold the bottle support sleeve, the bottle and a beverage extractor secured to the bottle.

6. The method of claim 1, wherein the step of injecting includes injecting pressure-regulated gas into the bottle at a pressure of 20-80 psi.

7. The method of claim 1, wherein the at least one needle includes a gas lumen for delivering the pressurized gas to the bottle and a beverage lumen for delivering extracted beverage from the bottle.

8. The method of claim 1, wherein the at least one needle includes a gas needle for delivering the pressurized gas to the bottle and a beverage needle for delivering extracted beverage from the bottle.

9. The method of claim 1, wherein the bottle is a wine bottle and the closure is a cork, and wherein the step of inserting includes inserting the at least one needle through the cork of the wine bottle.

10. The method of claim 1, wherein the step of securing includes securing at least one clamp arm of the beverage extractor to the bottle neck to support the beverage extractor on the bottle.

11. The method of claim 10, wherein the at least one clamp arm is secured to the bottle neck with sufficient force to permit lifting of the bottle by lifting the beverage extractor.

12. The method of claim 1, wherein the bottle support sleeve is constructed and arranged to resist puncture by a glass shard caused by breaking of the bottle when under pressure of 20-80 psi.

13. A method of extracting a beverage from a bottle having a neck with an opening closed by a closure, comprising:

providing the bottle in a bottle support sleeve such that only the neck and the closure are exposed outside of the bottle support sleeve and all remaining portions of the bottle are located in and covered by the bottle support sleeve, the bottle support sleeve being constructed and arranged to support portions of the bottle below the neck during extraction of beverage from the bottle and to vent any pressure introduced into the bottle that escapes through the bottle and into the bottle support sleeve;

securing a beverage extractor to the neck of the bottle;

securing the bottle support sleeve to the beverage extractor secured to the bottle to resist removal of the bottle support sleeve from the bottle;

inserting at least one needle of the beverage extractor through the closure such that a distal end of the at least one needle is positioned inside of the bottle;

injecting pressurized gas into the bottle via the at least one needle while the bottle is positioned in the bottle support sleeve; and extracting beverage from the bottle via the at least one needle while the bottle is positioned in the bottle support sleeve, wherein the bottle support sleeve and the beverage extractor each include complementary locking members arranged to engage with each other to secure the bottle support sleeve to the beverage extractor.

14. A method of extracting a beverage from a bottle having a neck with an opening closed by a closure, comprising:

providing the bottle in a bottle support sleeve such that only the neck and the closure are exposed outside of the bottle support sleeve and all remaining portions of the bottle are located in and covered by the bottle support sleeve, the bottle support sleeve being constructed and arranged to support portions of the bottle below the neck during extraction of beverage from the bottle and to vent any pressure introduced into the bottle that escapes through the bottle and into the bottle support sleeve;

securing a beverage extractor to the neck of the bottle;

inserting at least one needle of the beverage extractor through the closure such that a distal end of the at least one needle is positioned inside of the bottle;

enabling the beverage extractor to inject pressurized gas only in response to the beverage extractor recognizing an indicator of the bottle support sleeve;

injecting pressurized gas into the bottle via the at least one needle while the bottle is positioned in the bottle support sleeve; and extracting beverage from the bottle via the at least one needle while the bottle is positioned in the bottle support sleeve.

15. The method of claim 14, wherein the step of enabling the beverage extractor comprises the beverage extractor recognizing a machine readable identifier of the bottle support sleeve.

16. A method of extracting a beverage from a bottle having a neck with an opening closed by a closure, comprising:

providing the bottle containing the beverage, the bottle being made of glass;

providing the bottle in a bottle support sleeve such that only the neck and the closure are exposed outside of the bottle support sleeve and all remaining portions of the bottle are located in and covered by the bottle support sleeve, the bottle support sleeve being made of a flexible fabric and constructed and arranged to support portions of the bottle below the neck during extraction of beverage from the bottle and to vent any pressure introduced into the bottle that escapes through the bottle and into the bottle support sleeve;

securing a beverage extractor to the neck of the bottle;

inserting at least one needle of the beverage extractor through the closure such that a distal end of the at least one needle is positioned inside of the bottle;

injecting pressurized gas into the bottle via the at least one needle while the bottle is positioned in the bottle support sleeve; and extracting beverage from the bottle via the at least one needle while the bottle is positioned in the bottle support sleeve.

* * * * *